US010804599B2

(12) United States Patent
Abadia et al.

(10) Patent No.: US 10,804,599 B2
(45) Date of Patent: Oct. 13, 2020

(54) BTE HEARING INSTRUMENT COMPRISING A LOOP ANTENNA

(71) Applicant: Sonova AG, Staefa (CH)

(72) Inventors: Javier Abadia, Neuchatel (CH); Yves Oesch, Neuchatel (CH); Francois Callias, Fontaines (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/471,008

(22) PCT Filed: Dec. 20, 2016

(86) PCT No.: PCT/EP2016/081958

§ 371 (c)(1),
(2) Date: Jun. 19, 2019

(87) PCT Pub. No.: WO2018/113927

PCT Pub. Date: Jun. 28, 2018

(65) Prior Publication Data

US 2020/0091592 A1 Mar. 19, 2020

(51) Int. Cl.

| | |
|---|---|
| ***H04R 25/00*** | (2006.01) |
| ***H01Q 1/27*** | (2006.01) |
| ***H01Q 7/00*** | (2006.01) |
| ***H01Q 7/08*** | (2006.01) |

(52) U.S. Cl.

CPC ..... *H01Q 1/273* (2013.01); *H01Q 7/00* (2013.01); *H01Q 7/08* (2013.01); *H04R 25/552* (2013.01); *H04R 25/554* (2013.01); *H04R 25/558* (2013.01); *H04R 25/60* (2013.01); *H04R 2225/51* (2013.01)

(58) Field of Classification Search

CPC ... H04R 2225/51; H04R 25/554; H04R 25/60
See application file for complete search history.

(56) References Cited

U.S. PATENT DOCUMENTS

| | | | |
|---|---|---|---|
| 5,995,054 | A | 11/1999 | Massey |
| 9,369,813 | B2 | 6/2016 | Kvist |
| 9,466,876 | B2 | 10/2016 | Kerselaers et al. |
| 2015/0281859 | A1 | 10/2015 | Fischer |
| 2016/0050502 | A1 | 2/2016 | Kvist et al. |

(Continued)

FOREIGN PATENT DOCUMENTS

| | | | |
|---|---|---|---|
| EP | 2458675 | A2 | 5/2012 |
| EP | 2723101 | A2 | 4/2014 |
| EP | 2871860 | A1 | 5/2015 |

(Continued)

OTHER PUBLICATIONS

Dong Hyun Lee et al: "A compact and Low-Profile Tunable Loop Antenna Integrated With Inductors", IEEE Antennas and Wireless Propogation Letters, IEEE, Piscataway, NJ, US, vol. 7, Jan. 1, 2008, pp. 621-624.

*Primary Examiner* — Kile O Blair
(74) *Attorney, Agent, or Firm* — ALG Intellectual Property, LLC

(57) ABSTRACT

There is provided a hearing instrument comprising a BTE part to be worn behind the ear of a user (76), the BTE-part comprising: a first side, a second side substantially parallel to the first side, and a third side connecting the first side and the second side, wherein the first and second side are substantially parallel to the user's skin when the BTE part is worn behind the ear.

19 Claims, 3 Drawing Sheets

(56) References Cited

U.S. PATENT DOCUMENTS

2016/0241973 A1 8/2016 Murray et al.

FOREIGN PATENT DOCUMENTS

| | | | |
|---|---|---|---|
| EP | 2985 834 | A1 | 2/2016 |
| EP | 3110171 | A1 | 12/2016 |
| EP | 3313096 | A1 | 4/2018 |
| FR | 2 869 707 | A1 | 11/2005 |
| WO | WO 2012/059302 | A2 | 5/2012 |
| WO | WO 2014/090419 | A1 | 6/2014 |
| WO | WO 2016/130590 | A1 | 2/2016 |

BTE HEARING INSTRUMENT COMPRISING A LOOP ANTENNA

The invention relates to a hearing instrument comprising a part to be worn behind the ear of a user (i.e. a Behind-The-Ear (BTE) part) comprising a loop antenna.

In general, different types of antennas may be used with BTE hearing instruments.

WO 2012/059302 A2 relates to an antenna known as "inverted-L antenna", which may be used in e.g. in a BTE hearing aid and which is a vertical antenna having a short vertical element prolonged by a wire parallel to a conductive ground plane. The antenna operates like a monopole folded by 90° and creates a capacitive effect causing the overall length of the antenna to be slightly shorter than $\lambda/4$. Typically, such antennas are used on the short wave frequencies, below 10 MHz.

EP 2 458 675 A2 relates to an antenna for a BTE hearing aid having a first L-shaped part placed on one side of the hearing aid housing and a second part having the form of a meander line and being placed on the opposite side of the housing, with a conductive part connecting the two parts. The antenna excitation point is between the first part and the conductive part.

EP 2 723 101 A2 relates to a BTE hearing aid having a balanced antenna for use at 2.4 GHz, which comprises a first resonant structure located on one side of the housing and a second resonant structure symmetric with regard to the first resonant structure and located on the opposite side of the housing, with a conductive segment providing a current bridge between the two resonant structures, wherein each resonant structure is fed through a transmission line. The resonant structures may have the form of a straight line, a meander line, a sheet or a closed oval line. EP 2 871 860 A1 relates to a variant of such antenna type, wherein the first resonant structure is fed through a transmission line, and the feeding point of the second resonant structure is connected to the ground plane of the hearing aid electronic module.

US 2016/0183015 A1 relates to a BTE hearing aid comprising an antenna having two arms which are separated by a slot and extend in parallel along the length of the upper side of the housing. The arms comprise loading wings angled by about 90° with regard to the arms and extending along the sides of the housing adjacent to the upper side of the housing.

WO 2016/130590 A1 relates to a BTE hearing aid comprising an antenna with two arms, each of which extends along one of the lateral sides of the housing, with the arms being connected at one end by a conducting bridge. In one example, the free ends of the arms comprise a tuning stub which is angled by 90° with regard to the arm and is located in the same plane as the arm.

U.S. Pat. No. 9,466,876 B2 relates to an antenna for a BTE hearing aid which comprises two arc-shaped conducting elements extending along the sides of the housing parallel to the user's skin and being connected by a conducting bridge in a middle portion.

WO 2007/112838 A1 relates to an RF receiver device which may be connected to a BTE hearing aid via a three pin plug connector and which comprises a magnetic loop antenna on a flexible printed circuit board (PCB) comprising two parts which are oriented at an angle of about 90° relative to each other.

It is an object of the invention to provide for a hearing instrument comprising a part to be worn behind the ear of a user and including an antenna which should be efficient both for wireless communication via a binaural link and for wireless communication with remote devices.

According to the invention, this object is achieved by a hearing instrument as defined in claim 1.

The invention is beneficial in that, by providing the loop antenna with a U-shaped contour comprising two legs connected by a base portion and with a tuning capacitor comprising a first capacitor plate at the free end of one of the legs and a second capacitor plate at the free end of the other leg, with the capacitor plates being located at a second side and third side of the housing, respectively, adjacent to the first side of the housing where the U-shaped contour is located, and with the free ends of the legs being located closer to a battery of the BTE part than the base portion, a resonant loop antenna can be realized at frequencies from 1 to 6 GHz despite the typically relatively small BTE housing; in particular, the antenna enables high radiation efficiency along the head surface, while keeping good performance for a communication with wireless companion devices located at a certain distance from the BTE part. Further, the antenna performance is substantially insensitive to the orientation placement of the BTE part behind the head.

Preferred embodiments of the invention are defined in the dependent claims.

Hereinafter, examples of the invention will be illustrated by reference to the attached drawings, wherein.

Figure 1:
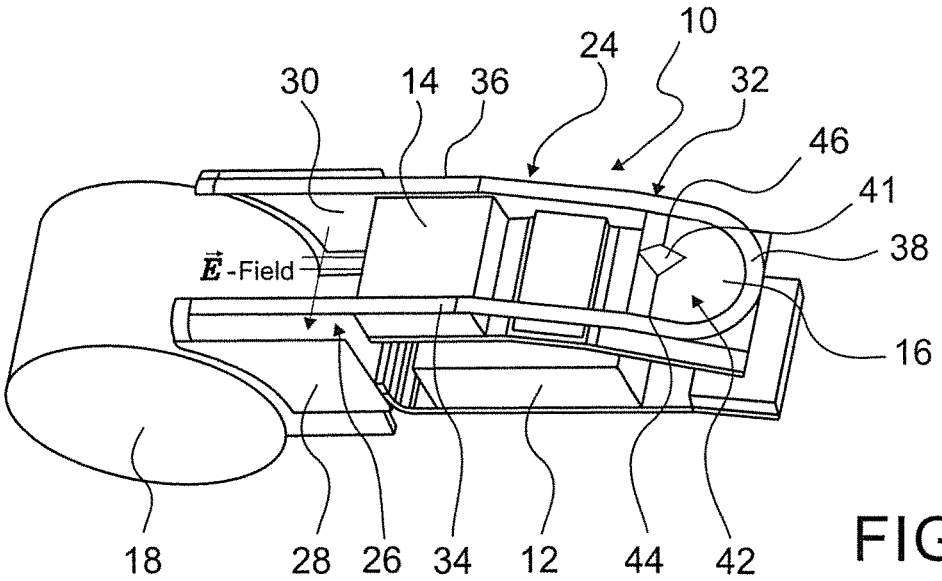
FIG. 1 is a perspective schematic view of components of a first example of a BTE part of a hearing instrument according to the invention.
Figure 2:
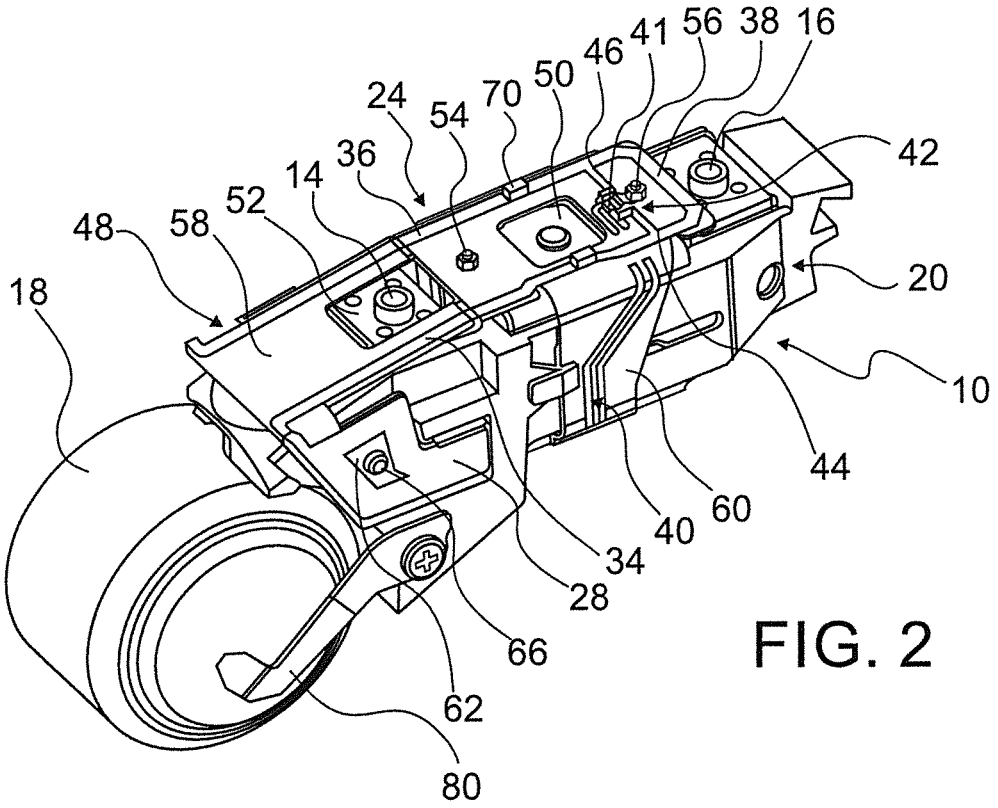
FIGS. 2 and 3 are two different perspective views of a second, more detailed example of components of a BTE part of a hearing instrument according to the invention.
Figure 3:
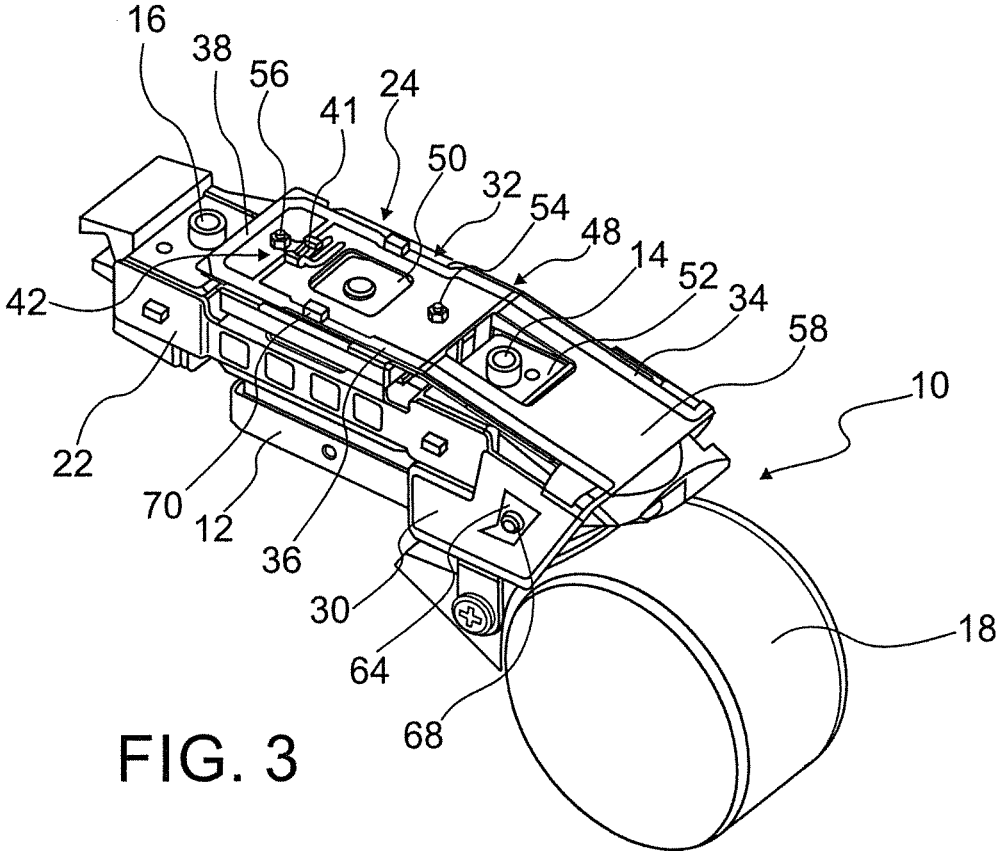

FIGS. 1 to 3 relate to a BTE part 10 of a hearing instrument, which is to be worn behind the ear of a user. The hearing instrument may be, for example, a BTE hearing aid (wherein the speaker is located in the BTE part) or a RIC hearing aid (wherein the speaker is located in the ear canal and is electrically connected to the BTE part). Alternatively, the hearing instrument may be an implantable hearing prosthesis, such as a cochlear implant system, wherein the BTE part 10 then is a BTE sound processor.

The BTE part 10 comprises a housing (not shown) and has a first side substantially parallel to the user's skin when the housing is worn behind the ear, a second side substantially parallel to the first side and a third side connecting the first side and the second side and oriented substantially upwardly when the housing is worn behind the ear. The BTE part 10 further comprises a radio circuit 12 acting as an RF transmitter or transceiver, a first microphone 14, a second microphone 16, a battery 18, a frame 20 made of plastic material for supporting components of the BTE part, electronic circuitry 22 and an antenna 24 placed on the upper side of the hearing instrument. Typically, the BTE part 10 includes additional components which are not shown in the Figures, such as a user interface with at least one push button, a speaker, etc.

The transmitter/transceiver 12 is designed for transmission at frequencies from 1 to 6 GHz, preferably from 2.40 to 2.48 GHz. For example, at a frequency of 2.4 GHz, a "full-size" loop antenna would require a periphery of 62 mm, which would be too large for a typical BTE housing. Simply reducing the size of the antenna would result in degradation of antenna efficiency. In order to avoid such degradation, in the example of FIGS. 1 to 3 the antenna 24 is provided with a tuning capacitor 26 comprising a first capacitor plate 28 and a second capacitor plate 30 parallel to the first capacitor plate 28, wherein the first plate 28 is arranged at one of the sides of the BTE part 10 parallel to the user's skin and the second plate 30 is arranged at the other side of the BTE part 10 parallel to the user's skin. Typically, the distance between the capacitor plates 28, 30 is at least 2.5 mm. Thereby a relatively large tuning capacitor can be implemented, so that the antenna 24 can be tuned e.g. to a resonance frequency of 2.4 GHz despite relatively small antenna dimensions.

The antenna 24, in addition to the tuning capacitor 26, comprises a loop conductor 32 having a U-shaped contour comprising a first leg 34 and a second leg 36 which are connected by a base portion 38, with the tuning capacitor 26 being provided at the free ends of the legs 34, 36, i.e. the first capacitor plate 28 is located at and connected to the free end of the first leg 34, and the second capacitor plate 30 is located at and connected to the free end of the second leg 36. The loop conductor 32 is located at the upper side of the BTE part 10, i.e. it is located at and substantially parallel to the upwards oriented third side of the housing.

The legs 34, 36 are parallel to each other and preferably extend over most (typically at least two thirds) of the length of the third side of the housing. The distance between the legs 34, 36 typically is at least 1.5 mm and the width of each leg 34, 36 preferably is from 0.2 to 1.0 mm, typically 0.6 mm.

The free ends of the legs 34, 36, together with the tuning capacitor 26, are located closer to the battery 18 than the base portion 38 of the loop conductor 32, i.e. free ends of the legs 34, 36 with the tuning capacitor 26 are oriented towards the battery 18 which is connected by a battery contact 80.

The structure of the antenna 24 is differential, so that it does not require any ground plane to work properly. The antenna 24 may be fed by a bifilar transmission line 40 which is connected to the loop conductor 32 through a matching network 41, thereby forming a differential feed structure 42 connected to each of the legs 34, 36 at a feed point 44 and 46, respectively. Preferably, each feed point 44, 46 is located at a position within that half of the respective leg 34, 36 which is closer to the base portion 38. Preferably, the feed points 44, 46 are arranged mirror-symmetric with regard to each other. Typically, the entire antenna structure is mirror-symmetric with regard to a plane extending in the longitudinal direction of the BTE part 10.

As illustrated in the example of FIGS. 2 and 3, the loop conductor 32 may be formed on a flexible PCB 48 which has an opening 50 for a push button of the user interface and an opening 52 for the first microphone 14. Additional openings may be provided for fixation of the PCB 48, as indicated by the fixation elements 54 and 56, and, in some cases, for the second microphone 16.

According to the example of FIGS. 2 and 3, the PCB 48 comprises, in addition to the first portion 58 on which the loop conductor 32 is implemented, a second portion 60 on which the transmission line 40 is implemented, with the second portion 60 with the transmission line 40 being folded by about 90° with regard to the first portion 58, with the second portion 60 being located at the same side as and substantially parallel with regard to one of the capacitor plates (in the example of FIG. 2, the second portion 60 is located at the side of the BTE part 10 at which also the first capacitor plate 28 is located).

As shown in the example of FIGS. 2 and 3, the capacitor plates 28, 30 may be implemented as conductors on a PCB which may form part of the flexible PCB 48, with the portions of the PCB 48 forming the capacitor plates 28, 30 being folded by about 90° with regard to the first portion 58 of the PCB 48 carrying the loop conductor 32.

As can be seen in FIGS. 1 to 3, each capacitor plate 28, 30 is connected to the respective leg 34, 36 of the loop conductor 32 only at that end of the capacitor plate which is farther away from the base portion 38 of the loop conductor 32. The surface area of each of the capacitor plates 28, 30 may be from 1.5 to 100 $mm^2$, preferably from 5 to 20 $mm^2$. As illustrated in FIGS. 2 and 3 each capacitor plate 28, 30 may be provided with at least one opening 62, 64 (actually, the "opening" in the example of FIGS. 2 and 3 is an opening in the conductor, but not necessarily in the PCB; however, as illustrated in FIGS. 2 and 3, a smaller opening may be provided also in the PCB for receiving, for example, a fixation element 66, 68. The total area of such openings 62, 64 in the capacitor plates 28, 30 may be from 1% to 90% of the total area of the respective capacitor plate 28, 30, preferably from 50% to 90%.

According to one example, the loop conductor 32 may have a substantially planar configuration (within 5 degrees). However, the legs 34, 36 preferably are curved or angled along their length between the free end connected to the respective capacitor plate 28, 30 and the end connected to the base portion 38 by more than 5° and less than 20° in order to allow for a curvature of the respective side of the housing.

Figure 5:
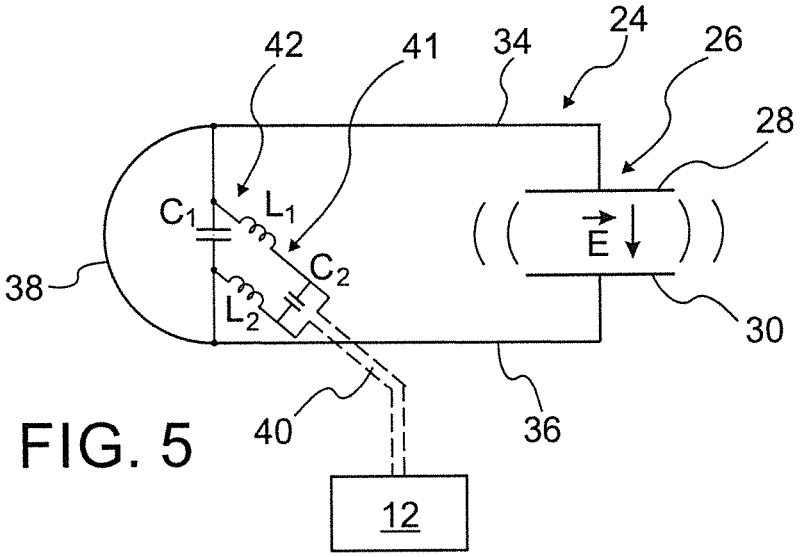
FIG. 5 is a schematic circuit diagram of an example of an antenna according to the invention.

The feed structure 42 typically comprises a matching circuit/network 41 configured to match the impedance of the antenna 24 to that of the transmission line 40. As illustrated in FIG. 5, the matching circuit 41 may include two inductances L1 and L2 which are connected at both ends by a capacitor C1 and C2, respectively, wherein one end of each inductance L1, L2 is connected to one of the strands of the transmission line 40 and the other end of each inductance L1, L2 is connected to one of the feed points 44 and 46, respectively. Changing the distance between the base portion 38 of the loop and the feed points 44, 46 results in a change of the input impedance of the antenna 24, since the impedance seen between the feed points 44 and 46 is usually not equal to the impedance of the transmission line 40. The matching circuit 41 ensures matching of the impedances, so that the impedance seen by the transmission line 40 over its connection points to the capacitance C2 equals the impedance Z0 of the transmission line 40, thereby ensuring maximum energy transfer.

Figure 4:
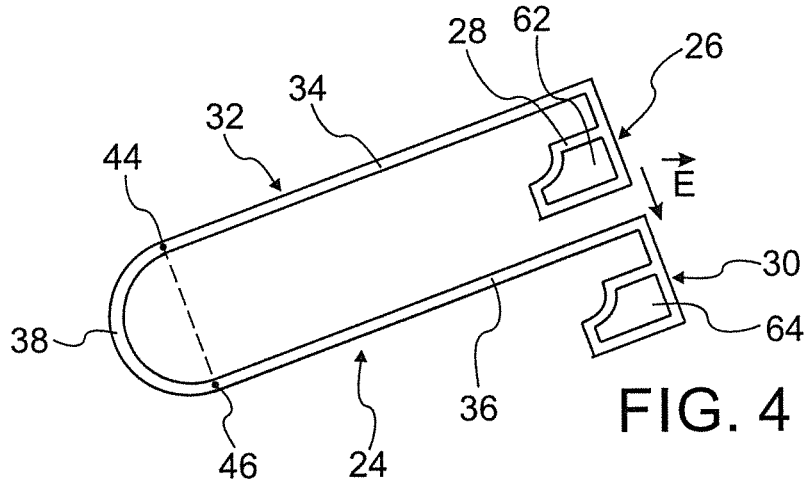
FIG. 4 is a schematic representation of the antenna of FIGS. 2 and 3.

As illustrated in FIG. 4, providing the capacitor plates 28, 30, with an opening decreases the capacitance value between the plates 28, 30 and also the capacitance value between the plates 28, 30 and their surroundings, like the electrical components of the BTE part 10 and the skin surface of the user. Decreasing the capacitance value of the tuning capacitor 26 increases the electrical field amplitude between the capacitor plates 28, 30 and thus the amplitude of radiated electromagnetic waves.

Preferably, the capacitor plates 28, 30 are placed on a metal-free zone of the BTE part 10.

As already mentioned above, the length of the legs 34, 36 is limited by the length of the BTE housing. Such length limitation may reduce the inductance value of the antenna, which reduction could be compensated by providing for an increased terminating capacitance which is provided by the tuning capacitor 26. However, since the dimensions of the tuning capacitor 26 and the capacity value should not be too high (an increased capacitance of the tuning capacitor results in reduced radiated electric field), discrete inductors may be provided as a tuning element 70 in each of the legs 34, 36 so as to "replace" at least part of the "missing" length. This provides for an overall antenna size reduction while keeping the dimensions of the radiating tuning capacitor 26 the same. In addition, when using serial discrete inductors as the tuning element 70, fine tuning of the antenna resonance frequency is enabled.

Figure 6:
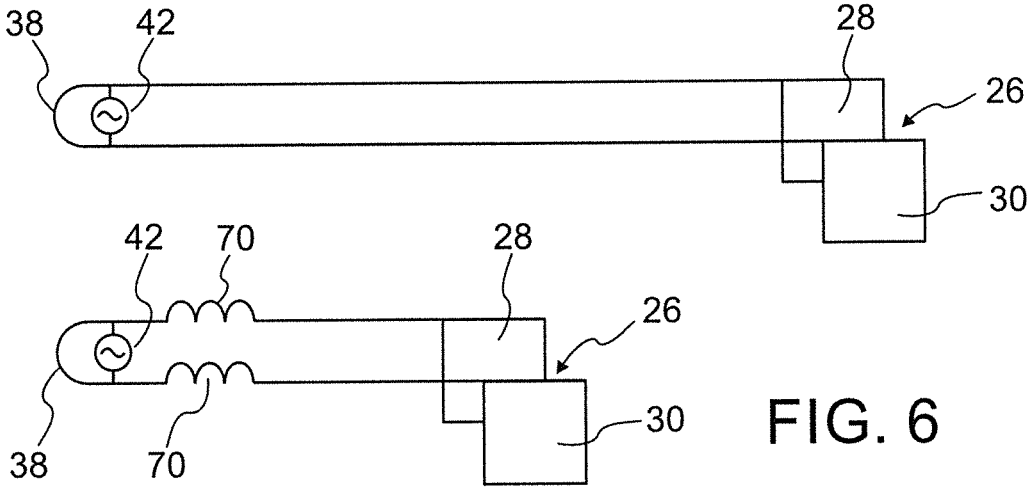
FIG. 6 is a schematic circuit diagram illustrating an antenna with tuning elements.

The principle of the length reduction of the antenna legs 34, 36 by inductors 70 is illustrated in FIG. 6. The transmission line 40 may be either located on one side of the BTE part 10, as shown in FIGS. 2 and 3, or it may be provided in an interior space, which provides for flexibility to the mechanical design. The impedance matching network 41 of the feed structure 42 located at the end of the transmission line 40 allows for fine tuning of both the resonant frequency and the input impedance of the antenna 24.

In general, antenna performance depends on the antenna length, the capacitor geometry and its surrounding. Best performance is obtained if the space between the capacitor plates 28, 30 is large and also if the parasitic capacitances between the capacitor plates 28, 30 and other conductive elements of the BTE part 10, like the battery 18 and electronic circuitry 12, 22, are kept as small as possible, thereby enhancing the amplitude of the electric field generated outside the BTE part 10. Accordingly, the radiating tuning capacitor 26 is placed close to the battery compartment which typically is the place where the BTE part 10 is the thickest, so that the maximum of space between the radiating plates 28, 30 is obtained. Such placement also ensures that the capacitor 26 will be located at the place in the BTE part 10 in which the path to the other ear has a minimum distance, yielding on an optimized binaural link budget. By contrast, placing the capacitor 26 at the other end of the BTE part 10 close to the second microphone 16 would not be optimal, since the thickness of the BTE part 10 is lower there, so that the distance between the capacitor plates would be less, which would increase the capacitance between the plates and accordingly produce a weaker radiated electric field; in addition, at such place parasitic coupling from the capacitor plates to other components, like the second microphone and a RIC connector, would be stronger, which would also increase the capacitance value, let alone the potential risk of self-interferences on the microphone signal if the microphone is immersed in a strong electric field.

As already mentioned above, the proposed antenna produces high voltage amplitude between the radiating capacitor plates 28, 30, so that a high electric field amplitude is produced between the capacitor plates 28, 30 which, in turn, produces an electromagnetic wave having an electric field component orthogonal to the skin, which is optimal for propagation by diffraction around the head.

Figure 7:
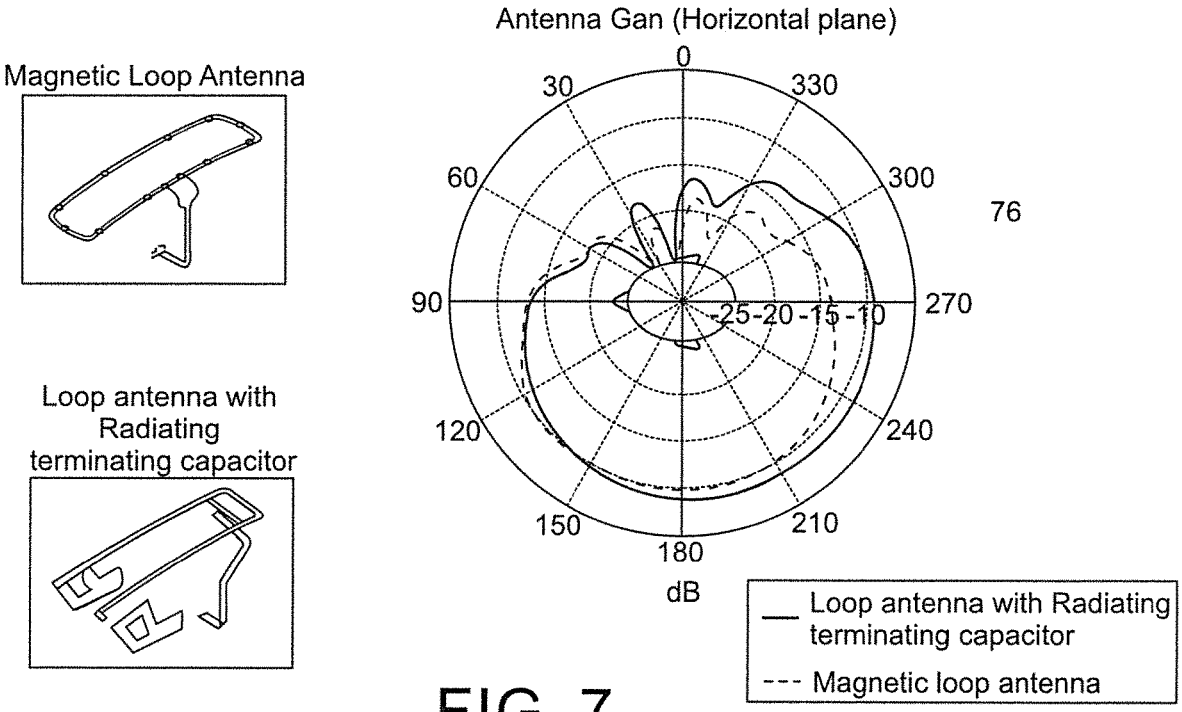
FIG. 7 is a representation of an example of the antenna gain in a horizontal plane of the user's head, wherein a conventional full magnetic loop antenna and an antenna according to the invention are compared.

This is illustrated in FIG. 7 which compares the radiation pattern of a conventional BTE part with a full size closed magnetic loop antenna and a BTE part provided with an antenna according to the invention, wherein the BTE part is placed at the left side of the head 76 between the skull and the auricle. It can be seen that the conventional magnetic loop antenna (dashed line in FIG. 7) has a radiation maximum in a direction orthogonal to the head 76 (at 180°), while the loop antenna according to the invention (solid line in FIG. 7) has a radiation maximum that is oriented at about 225°, between the side and the rear of the head 76, with the gain in the rearward direction (270°) being by 5 dB higher for the loop antenna according to the invention than for the conventional magnetic loop antenna.

The best propagation path for a binaural link is by diffraction around the neck, since this path is shorter than other paths, such as the path around the top of the head or the path around the forehead which is partly obstructed by the auricle. With the antenna of the invention in the example of FIG. 7 having 5 dB more gain in the direction of the neck than the conventional magnetic loop antenna, using the antenna of the invention in a binaural link between a left ear BTE hearing instrument and a right ear BTE hearing instrument would provide for a 10 dB advantage over a conventional magnetic loop antenna (both the antenna at the left ear and the antenna at the right ear would have 5 dB more gain in the direction of the main propagation path around the neck).

The invention claimed is:

1. A hearing instrument comprising a behind-the-ear (BTE) part to be worn behind an ear of a user, BTE part comprising:

a first side, a second side substantially parallel to the first side, and a third side connecting the first side and the second side, wherein the first and second side are substantially parallel to the user's skin when the BTE part is worn behind the ear;

a loop antenna comprising a loop conductor located at and substantially parallel to the third side of the BTE part and having a U-shaped contour comprising two legs connected by a base portion, a tuning capacitor comprising a first capacitor plate provided at a free end of one of the legs of the loop conductor and located at and substantially parallel to the first side and a second capacitor plate provided at a free end of the other one of the legs of the loop conductor and located at and substantially parallel to the second side, and a differential feed structure connected to each of the legs at a feed point, wherein the free ends of the legs of the loop conductor with the first and second capacitor plates are located closer to a battery of the hearing instrument than the base portion of the loop conductor; and a transceiver designed for transmission and reception at frequencies from 1 to 6 GHz and connected to the differential feed structure of the loop antenna via a transmission line.

2. The hearing instrument of claim 1, wherein each feed point is located at a position within that half of the respective leg closer to the base portion.

3. The hearing instrument of claim 2, wherein the feed points are arranged mirror-symmetric with regard to each other.

4. The hearing instrument of claim 3, wherein the transmission line is bifilar.

5. The hearing instrument of claim 1, wherein the differential feed structure comprises a matching circuit configured to match impedance of the loop antenna to that of the transmission line, wherein the differential matching circuit includes two inductances that are coupled at each end by a capacitor, wherein one end of each inductance is connected to a strand of the transmission line, and the other end of each inductance is connected to one of the feed points.

6. The hearing instrument of claim 1, wherein the loop antenna comprises a flexible printed circuit board (PCB) which includes a first portion on which the loop conductor is formed, and a second portion on which the transmission line is implemented as a conductor.

7. The hearing instrument of claim 6, wherein the second portion of the flexible PCB with the transmission line is folded with regard to the first portion of the flexible PCB.

8. The hearing instrument of claim 7, wherein the second portion of the flexible PCB is substantially parallel to the first side or the second side of the BTE part, and wherein the first portion of the flexible PCB is substantially parallel to the third side.

9. The hearing instrument of claim 1, wherein a distance between the first and second capacitor plates is at least 2.5 mm.

10. The hearing instrument of claim 1, wherein each of the first and second capacitor plates is connected to the loop conductor only at that end of the respective capacitor plate which is farther away from the base portion of the loop conductor.

11. The hearing instrument of claim 1, wherein each of the first and second capacitor plates is formed on a printed circuit board (PCB).

12. The hearing instrument of claim 1, wherein the legs of the loop conductor extend substantially over an entire length of the third side.

13. The hearing instrument of claim 1, wherein a distance between the legs is at least 1.5 mm.

14. The hearing instrument of claim 1, wherein a width of each of the legs is from 0.2 to 0.8 mm.

15. The hearing instrument of claim 1, wherein the loop conductor is formed on a flexible printed circuit board (PCB).

16. The hearing instrument of claim 15, wherein the flexible PCB has at least one of an opening for a microphone or an opening for a push button.

17. The hearing instrument of claim 15, wherein the legs are curved along their length between an open end of the loop conductor and an end of the loop connector connected to the base portion by less than 20 degrees and more than 5 degrees.

18. The hearing instrument of claim 1, wherein the transceiver is designed for transmission and reception at frequencies from 2.40 to 2.48 GHz.

19. The hearing instrument of claim 1, wherein the BTE part is a BTE hearing aid, that includes at least one of a receiver-in-canal (RIC) hearing aid or a BTE sound processor of a cochlear implant.

* * * * *